US005325995A

United States Patent [19]

Harrison et al.

[11] Patent Number: 5,325,995

[45] Date of Patent: Jul. 5, 1994

[54] PIERCING NOZZLE FOR POUCH FITMENT

[75] Inventors: Raymond P. Harrison, Pontypool; Ralph C. Wirsig, Kingston, both of Canada

[73] Assignee: Du Pont Canada Inc., Mississauga, Canada

[21] Appl. No.: 51,826

[22] Filed: Apr. 26, 1993

Related U.S. Application Data

[63] Continuation of Ser. No. 828,919, Jan. 27, 1992, abandoned.

[30] Foreign Application Priority Data

Jul. 27, 1989 [GB] United Kingdom ..... 8917163

[51] Int. Cl.[5] ..... B67B 7/24

[52] U.S. Cl. ..... 222/81

[58] Field of Search ..... 222/81-90

[56] References Cited

U.S. PATENT DOCUMENTS

| | | | |
|---|---|---|---|
| 2,845,201 | 7/1958 | Henry | 222/89 |
| 3,220,610 | 11/1965 | Specketer | 222/90 |
| 4,022,258 | 5/1977 | Steidley | 222/81 X |
| 4,881,662 | 11/1989 | Tallman | 222/81 |

FOREIGN PATENT DOCUMENTS

| | | | |
|---|---|---|---|
| 525607 | 9/1982 | Australia . | |
| 1192164 | 8/1985 | Canada . | |
| 2525000 | 12/1976 | Fed. Rep. of Germany | 222/89 |
| 2610080 | 9/1977 | Fed. Rep. of Germany | 222/81 |
| 1082755 | 1/1955 | France | 222/81 |
| 2102773 | 2/1983 | United Kingdom | 222/81 |

*Primary Examiner*—David M. Mitchell
*Assistant Examiner*—Kenneth DeRosa

[57] ABSTRACT

An improved nozzle for piercing and draining a wide variety of fluid materials, such as milk, juice, relish and ketchup, from pouches of plastic film. The piercing nozzle is easily inserted into plastic pouches and is designed to provide that, after initial penetration, the force necessary to insert the piercing portion remains substantially constant.

4 Claims, 2 Drawing Sheets

PIERCING NOZZLE FOR POUCH FITMENT

This is a continuation of application Ser. No. 07/828,919 filed Jan. 27, 1992, now abandoned.

BACKGROUND OF THE INVENTION

The present invention relates to an improved piercing nozzle for pouch fitments, which are used to control the removal of the contents of filled thermoplastic polymeric film pouches.

As is known, the use of plastic pouches is common with respect to packaging certain liquids and other fluid materials, e.g. milk, fruit juices, relish and the like. The plastic pouches are often made of polyethylene film. In order to remove the contents from the pouch, a simple method of cutting one of the corners, for example with scissors, has sufficed for many end uses. However, with institutional purchasers, this is inconvenient and the snipped-off corner may contaminate the material after it has been poured or squeezed from the pouch.

It is desirable that the pouch has a pouring spout, preferably one that can be resealed. It is known to incorporate pouring spouts into plastic pouches but this is expensive because of the need for one pouring spout per pouch. It would be economically more desirable if the pouring spout was able to be inserted into the pouch and used until the pouch is empty, then removed and cleaned for re-use with another pouch.

One such pouring spout is disclosed in Canadian Patent 1 192 164 to L. Obidniak. In L. Obidniak's configuration, the pouring spout comprises an elongated body, one of the ends being pointed and the other being integrally prolonged by a threaded stem. A passage is provided for flow of liquid from the pouch. The disclosure of L. Obidniak indicates that the passage is preferably T-shaped. The T-shaped passage is ineffective for removing thick materials which include particulates therein, for example relish, from the pouch.

Another pouring spout is disclosed in GB-A-2 102 773 to J. F. Wood. Such a pouring spout is designed to cut the packaging material into which it is inserted. This is unsuitable for plastic pouches, particularly those containing liquids, because it is unable to provide a tight seal.

The present invention endeavours to provide a spout which is easily inserted into a plastic pouch and which is adapted to allow removal of a wide variety of materials from such pouch.

SUMMARY OF THE INVENTION

The present invention provides a spout, for insertion into and securement to a plastic pouch, comprising a tube having a piercing portion separated from a delivery portion by a film securement portion and having fluid flow communication from the piercing portion to the delivery portion; said film securement portion being adapted to secure, with a substantially liquid-tight seal, plastic film which has been pierced by the piercing portion; said piercing portion appearing, in one perspective, to have been sliced at an angle to the longitudinal axis, from a first location at one side of said tube adjacent the film securement portion to a second location at the other side of the tube, distal from the film securement portion, to form a tip, and the tip appearing, in a second perspective at 90° to the first perspective, to have been sliced symmetrically about the longitudinal axis of the tube to form a pointed piercing tip furthest away from the film securement portion.

DETAILED DESCRIPTION OF THE INVENTION

In one embodiment the contour of the piercing portion is such that when the pointed tip is pushed into a polyethylene film, in a direction parallel to the longitudinal axis of the tube, the force required to push the piercing nozzle into the polyethylene film remains substantially constant after the tip pierces the film until the pierced edges of the film reach a position adjacent the film securement portion.

In another embodiment the angle of the tip is less than about 75°.

In a further embodiment the angle of the tip is from 60° to 45°.

In another embodiment, the piercing portion has a wall tapering from being thick adjacent the film securement portion to thin furthest away from the film securement portion, such that the piercing portion is frustoconical.

In another embodiment the confluence and immediate surrounds of a) the portion appearing to have been sliced from one side of said tube to the other side of the tube and b) the portion appearing to have been sliced symmetrically about the longitudinal axis of the tube to form a pointed piercing tip, is shaped such that there is a smooth transition therebetween.

In yet another embodiment the edges of the piercing portion, at least adjacent the piercing tip, are keen.

In another embodiment the edges of the piercing portion, at least adjacent the piercing tip, are smoothed.

In another embodiment the film securement portion comprises a shoulder, a collar adapted to cooperate with the shoulder to trap said plastic film therebetween in a liquid-tight seal, and a locking nut adapted to hold the collar in engagement with the shoulder, and wherein the narrower portion of the shoulder faces the delivery portion.

In a further embodiment the delivery portion is adapted to have a cap or delivery nozzle attached thereto.

In yet another embodiment the piercing portion has a slot, in the sliced portion, which extends substantially to the shoulder.

In another embodiment the slice adjacent the film securement portion is in a plane at an angle of from 20° to 30° to the longitudinal axis of the tube.

In another embodiment the angle of the tip is from 60° to 45°.

In a further embodiment the internal diameter of the tube is from 10 to 30 mm.

Figure 1:
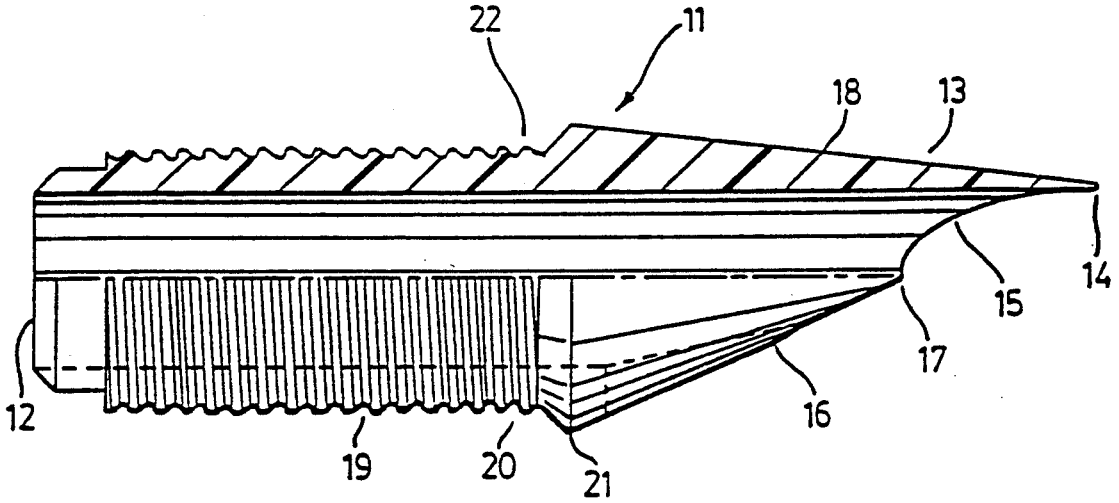
FIG. 1 is a partially cut away elevation view of one embodiment of the present invention.
Figure 2:
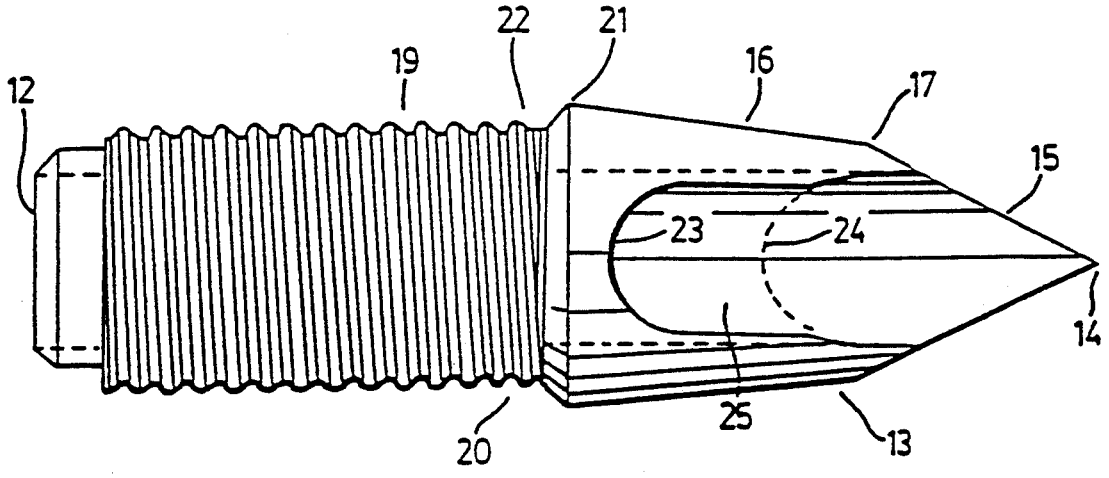
FIG. 2 is a plan view of the same embodiment when viewed from below FIG. 1.

In FIGS. 1 and 2, the spout comprises tube 11 having an open end 12 and a sharpened end 13. Open end 12 is the delivery portion of the spout and the sharpened end is the piercing portion of the spout. The piercing and delivery portions are joined by film securement portion 22. The sharpened end 13 comprises a point 14 with a first portion 15 which is adjacent to a second portion 16. There is a shoulder 17 at the juncture of the first and second portions. As will be apparent the second portion appears to have been formed by slicing a tube from adjacent the film securement portion, at point 23, to the opposite side of the tube, i.e. towards point 14. Typically, the angle of this slice is about 25° to the longitudinal axis of tube 11. The tube then appears to have been sliced along the edges of portion 15 to form point 14. The "slices" are symmetrical about the longitudinal axis of tube 11 and are in planes which intercept in a line, the projection of which includes both the longitudinal axis of tube 11 and the extreme tip of point 14. It is preferable that the resulting angle of the tip, at point 14, be from 60° to 45°. The angle of the tip is the included angle between the edges of portion 15. Typically, the angle of the slices which form portion 15 is about 28° to the longitudinal axis of tube 11, thus forming a tip angle of 56°. The confluence of portions 15 and 16 is, in this instance, at shoulder 17. It is preferable that shoulder 17 be smoothed rather than angular so that it is easier to push into the film of a pouch. The wall thickness of tube 11 adjacent shoulder 21 is thick relative to thickness at point 14, thus making tube 11 frusto-conical in the piercing portion of the spout. Preferably, the edge of tube 11 leading to point 14, of tube 24, i.e. edge 18, is tapered at a narrow taper, for example from about 3° to 10°, especially 5° to 8°. The spout also has a tubular portion 19 which is adapted to receive a locking nut (not shown) which may be threaded onto threads 20. Threads 20 are adjacent shoulder 21, the functions of which are explained more in detail hereinafter. Because of the thickness of tube 11, the "slice" which forms portion 16 would normally cause the opening at the piercing portion to extend from point 14 to the dotted line 24. It is preferred, however, that tube 11 be cut away to form a slot 25 which extends substantially to shoulder 21. Slot 25 is to aid in draining material from the pouch and the width of the slot will be determined, in part by the size of particulates, if any, in the material. It is preferable that the point 14 be slightly blunted so that it does not form a skin puncturing hazard for the operator. It will be apparent from the drawings that the piercing portion is shaped somewhat similar to a pen nib, but the function and the manner of attachment to the remainder of the apparatus is, of course, very dissimilar. The spout is preferably made from a stiff material, e.g. metal or hard plastic, and may be made by known methods such as machining or injection moulding.

Figure 3:
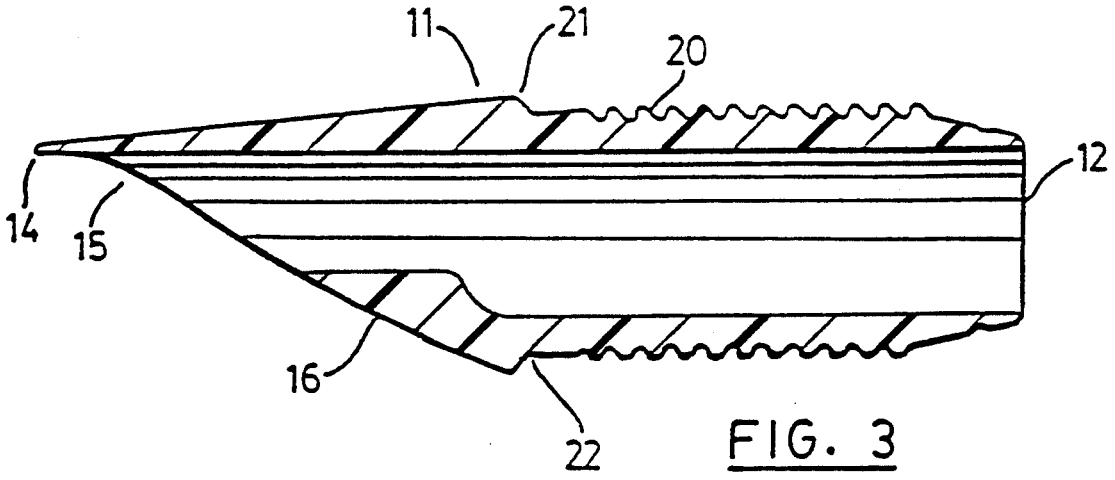
FIG. 3 is a fully cut away elevation view of another embodiment of the present invention.
Figure 4:
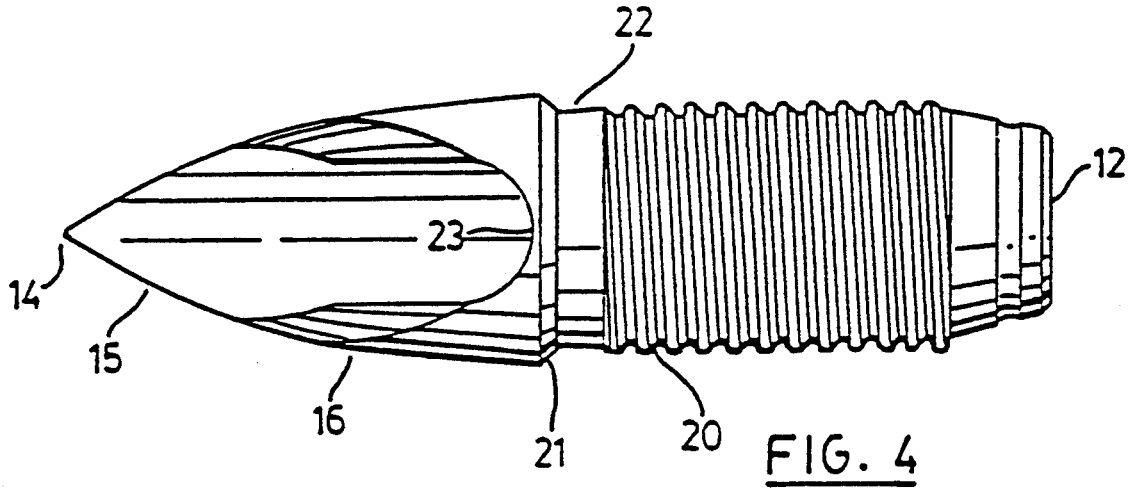
FIG. 4 is a plan view of the same embodiment when viewed from below FIG. 3.

Although in FIGS. 1 and 2 it appears that the "slices" are linear, it is to be understood that the slices may be arcuate. In FIGS. 3 and 4 the spout is somewhat similar to that of FIGS. 1 and 2 but the confluence between portions 15 and 16 have been smoothed in order to form a spout which is easier to insert into a pouch. Also shown in this embodiment is that the threads 20 are spaced further from shoulder 21 in order to leave a smooth tubular portion adjacent shoulder 21. In FIGS. 1 to 4, shoulder 21 and portions adjacent thereto may be referred to as the film securement portion. Adjacent point 14 and along the edges of portion 15 and into the confluence between portions 15 and 16 it is preferable that the edges be smoothed.

Figure 5:
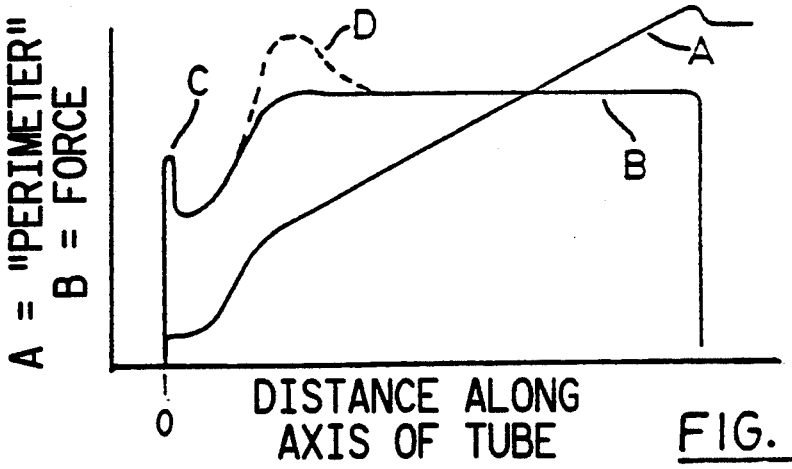
FIG. 5 is a compound plot of A) the perimeter of a cross-section of spout of FIGS. 3 and 4 vs. axial distance from the piercing point of the spout; and B) the force required to push the piercing portion of a spout into polyethylene film vs. axial position of the pierced film. Perimeter is defined by the length of a hypothetical thread drawn taut around the cross-section of the spout.

FIG. 5 is a combination of two graphs. With respect to line A, the abscissa relates to the distance along the longitudinal axis of tube 11, starting at point 14, and the ordinate shows the length of a single turn of taut thread which surrounds the spout at cross-sections of the spout, such cross-sections being at 90° to the longitudinal axis of tube 11. With respect to line B, the abscissa is the same as for line A and the ordinate shows the force required to push the piercing portion of the spout into a polyethylene film. Line A shows the "perimeter" of a spout similar to that shown in FIGS. 3 and 4, as a function of distance from the tip. Line B indicates the force required to push the piercing portion of the same spout into a polyethylene film, as a function of the distance from the tip. Spike C shows the force required to puncture the film initially. It will be seen that after the initial puncturing of the film, the force required for insertion of the piercing portion does not increase as the portion progressively penetrates the film. Indeed, in the embodiment shown, the force remains relatively constant. Dotted line D shows the force required when the confluence is not smoothed, as in the embodiment of FIGS. 1 and 2. As may be imagined, the embodiment shown with line A is preferred.

The spout of the present invention may be used for pouches containing a variety of different flowable materials, particularly foodstuffs, e.g. mayonnaise, relish, and the like. In operation a filled pouch is grasped, for example between thumb and forefinger, in such a manner that there is a slight negative pressure engendered in the pouch. The point 14 is then pushed into the film of the pouch, close to the place where the pouch was grasped. The spout is then pushed firmly into the pouch, so that the film is stretched around the perimeter of first portion 15 and then portion 16 until the hole in the pouch passes shoulder 21 and surrounds the tubular film securing portion. The collar (not shown) is placed over threads 20 and a locking nut (also not shown) is screwed tightly so that the film edges are trapped between shoulder 21 and the collar. The spout will then allow material from the pouch to flow through the tubular fitment. Slot 25 allows the material in the pouch to be almost completely drained from the pouch. The present invention is particularly desirable for spouts which have internal diameters of about 8 mm or more, and especially from 10 to 30 mm. Typically, the internal diameter of the spout is about 14 mm.

The spout may have attached thereto, at end 12, a closure device (cap) so that the pouch may be stored without material leaking therefrom through the spout. Alternatively, the spout may have various fitments attached thereto, for example piping nozzles used for icing sugar. The cap or fitments fit against end 12 and are held in place by a further securing nut (not shown) or similar.

We claim:

1. A spout for insertion into and securement to a plastic film pouch comprising a tube having (A) a piercing portion at one end of said tube;

(B) a delivery portion at the opposite end of said tube; and (C) a film securement portion joining said piercing portion to said delivery portion;

said tube having a longitudinal passage for providing fluid flow communication from the piercing portion to the delivery portion;

said film securement portion being adapted to secure, with a substantially liquid-tight seal, the film of said plastic pouch having been pierced by said piercing portion, said piercing portion having its shape essentially defined by (1) one slice further defined by a plane at a first angle to the axis of said tube to form a tip at said one end of said tube; and (2) an additional two slices being symmetrical about said axis to form a point at said tip at said one end of said tube furthest away from said film securement portion, each of said additional two slices defined by a plane at a second angle to the axis of said tube, the second angle being different from said first angle;

said slice and said additional two slices having a confluence therebetween to form a shoulder.

2. A spout of claim 1 wherein said shoulder is smooth.

3. A spout of claim 1 wherein edges adjacent said point and along said additional two slices are smooth.

4. A spout of claim 1 wherein said tube is frusto-conical.

* * * * *